US006546696B2

(12) United States Patent
Cranston, III et al.

(10) Patent No.: US 6,546,696 B2
(45) Date of Patent: Apr. 15, 2003

(54) APPARATUS AND METHOD FOR SECURING A BUNDLE WITH A STRAP

(75) Inventors: Albert E. Cranston, III, Oregon City, OR (US); Bobbie Don Peacock, Peachtree City, GA (US)

(73) Assignee: Cranston Diversified Industries, Oak Grove, OR (US)

( * ) Notice: Subject to any disclaimer, the term of this patent is extended or adjusted under 35 U.S.C. 154(b) by 23 days.

(21) Appl. No.: 09/788,221

(22) Filed: Feb. 15, 2001

(65) Prior Publication Data

US 2002/0116900 A1 Aug. 29, 2002

(51) Int. Cl.[7] ..... B65B 13/32

(52) U.S. Cl. ..... 53/399; 53/589; 100/2; 100/26; 100/33 PB

(58) Field of Search ..... 100/2, 26, 29, 100/32, 33 PB; 53/399, 589

(56) References Cited

U.S. PATENT DOCUMENTS

| | | | | |
|---|---|---|---|---|
| 3,003,296 A | | 10/1961 | Feldkamp et al. | |
| 3,330,409 A | * | 7/1967 | Jorgensen | 100/1 |
| 3,470,814 A | | 10/1969 | Tschappu | |
| 3,847,071 A | * | 11/1974 | Goodley | 100/32 |
| 3,914,153 A | | 10/1975 | Sato | |
| 4,016,023 A | * | 4/1977 | Takami | 100/33 PB |
| 4,155,213 A | * | 5/1979 | Blanton et al. | 53/587 |
| 4,177,724 A | | 12/1979 | Johnson, III et al. | |
| 4,435,945 A | | 3/1984 | Röhrig | |
| 4,499,709 A | * | 2/1985 | Miyano et al. | 53/589 |
| 4,520,720 A | | 6/1985 | Urban et al. | |
| 4,627,219 A | * | 12/1986 | Omori | 53/399 |
| 4,659,029 A | | 4/1987 | Rodriguez | |
| 4,661,185 A | | 4/1987 | Kobiella | |
| 4,757,950 A | | 7/1988 | Rodriguez | |
| 4,776,905 A | * | 10/1988 | Cheung et al. | 100/33 PB |
| 4,781,110 A | | 11/1988 | Sakaki et al. | |
| 4,896,482 A | | 1/1990 | Bohl et al. | |
| 4,938,009 A | | 7/1990 | Takami | |
| 5,267,508 A | * | 12/1993 | Yoshi | 100/26 |
| 5,299,407 A | | 4/1994 | Schuttler et al. | |
| 5,350,630 A | * | 9/1994 | Schreiner et al. | 428/343 |
| 5,417,383 A | | 5/1995 | Rodriguez et al. | |
| 5,437,141 A | | 8/1995 | Baumann | |
| 5,456,792 A | | 10/1995 | Rodriguez et al. | |
| 5,467,937 A | | 11/1995 | Rodriguez | |
| 5,526,632 A | | 6/1996 | Weder et al. | |
| 5,542,239 A | | 8/1996 | Fujii et al. | |
| 5,560,180 A | | 10/1996 | Rodriguez et al. | |
| 5,890,423 A | | 4/1999 | Lih | |
| 6,363,689 B1 | | 4/2002 | Rodriguez et al. | 53/399 |

FOREIGN PATENT DOCUMENTS

| | | | | |
|---|---|---|---|---|
| JP | 9-301322 A | * | 11/1997 | B65B/13/32 |
| JP | 2000-302104 A | * | 10/2000 | B65B/13/32 |

* cited by examiner

*Primary Examiner*—Stephen F. Gerrity
(74) *Attorney, Agent, or Firm*—Klarquist Sparkman, LLP

(57) ABSTRACT

Method and apparatus for binding a bundle using an elongate flat strap having a heat sensitive adhesive thereon. The apparatus includes mechanism for driving the strap in a loop around the bundle, a gripper for gripping an end of the strap, mechanism for drawing the strap taut about the bundle, and heated press elements for clamping adjacent overlapping portions of the strap together to reactivate adhesive in the strap to bond the overlapping sections together. A cutter severs remainder portions of the strap.

55 Claims, 5 Drawing Sheets

APPARATUS AND METHOD FOR SECURING A BUNDLE WITH A STRAP

BACKGROUND OF THE INVENTION

This invention relates to a method and apparatus for securing a bundle with strapping material, and more particularly to securing a package or bundle with a strap having a heat sensitive adhesive thereon which may be reactivated by application of heat.

Machines and methods are known for forming a tensioned loop of strapping material about a bundle. Such machines often include means for forming a strap loop around the object, means for pulling the strap loop trailing portion to tension the strap loop about the object, means for securing the overlapping strap portions together, and means for severing the strap trailing portion from the loop.

In the past, strapping used may have been made of thermoplastic material. A heating element was inserted between two overlapping portions of the strap to heat and somewhat melt the thermoplastic material, the heating element had to be removed from the position between the two strap portions and the two strap portions had to be immediately pressed together under pressure to adhere them to each other.

In other prior apparatus and methods an adhesive was injected into the space between the two overlapping portions of the strap prior to their being pressed together. In some applications a moisture sensitive adhesive may be part of the strap and application of moisture, such as water, in the space between the overlapping strap portions activated the adhesive previously applied to the overlapping strap sections, after which they are then pressed together for joining.

In other prior strapping apparatus and methods, metal strapping or wire has been used, with overlapping sections secured together either by fusion welding to each other or by being clamped or tied together to secure the overlapping portions.

Although metal strap and wire works well to secure a bundle, such is not always well adapted for safety and recycling. Explaining further, when metal or wire strapping is released, since it is under tension, the cut ends may fly from the packaged articles creating a safety hazard. Further, if the bundled materials are of a fibrous nature which is to be recycled, such as by being broken down or re-pulped, a metal, wire, or thermoplastic strap may produce problems should it be passed into the deconstructing or repulping process.

Various pulpable strap material has been devised recently. One such strapping tape material comprises multiple elongate elements secured together by a heat sensitive adhesive which may be reactivated by application of heat. These multiple elongate elements, or strands, may be twisted paper or yarn elements forming long string-like elements which are adhered together in adjacent, side-by-side orientation to form a substantially flat tape or strap. The adhesives and strand material used in the manufacture of such a strap may be specifically formulated to be easily repulped. The adhesive may be applied cold or heated and may be a heat sensitive adhesive which may be reactivated by the application of heat.

Other strapping has been made that is a flat strap made of multiple folds of a wider thin sheet of paper-like material. These folds may be held together by an adhesive and thus laminated one over the other to form a flat strap.

SUMMARY OF THE INVENTION

An object of this invention is to provide a method for binding a bundle by providing an elongate strap having a heat sensitive adhesive thereon which may be reactivated by the application of heat, extending the strap about a bundle, drawing the strap taut about the bundle with portions of the strap overlapping, pressing the overlapping portions of the strap together, and simultaneously applying heat to at least one external surface of the overlapping portions of the strap to reactivate the adhesive to bond the strap portions together.

Another object of the invention is to provide apparatus for binding a bundle with an elongate strap having heat sensitive adhesive thereon which may be reactivated by application of heat. The apparatus includes mechanism for feeding the strap to form a loop about the bundle with a leading end portion, overlapping first and second strap portions, and a trailing portion of the strap. A pair of opposed press elements are disposed on opposite sides of the overlapping strap portions with at least one of the press elements being heated. Clamping mechanism is operable to shift at least one of the press elements toward the overlapping strap portions to apply heat and pressure externally thereto to reactivate the adhesive in the strap material to secure the overlapping strap portions together.

Further, the apparatus is such that operating mechanism for gripping, clamping, and severing remainder portions of the tape are shiftable between first positions for operating upon the tape to bind it about a bundle, and second positions laterally therefrom to release the tape to surround the bundle and allow the bundle to be removed from the apparatus.

DETAILED DESCRIPTION OF A PREFERRED EMBODIMENT

Figure 1:
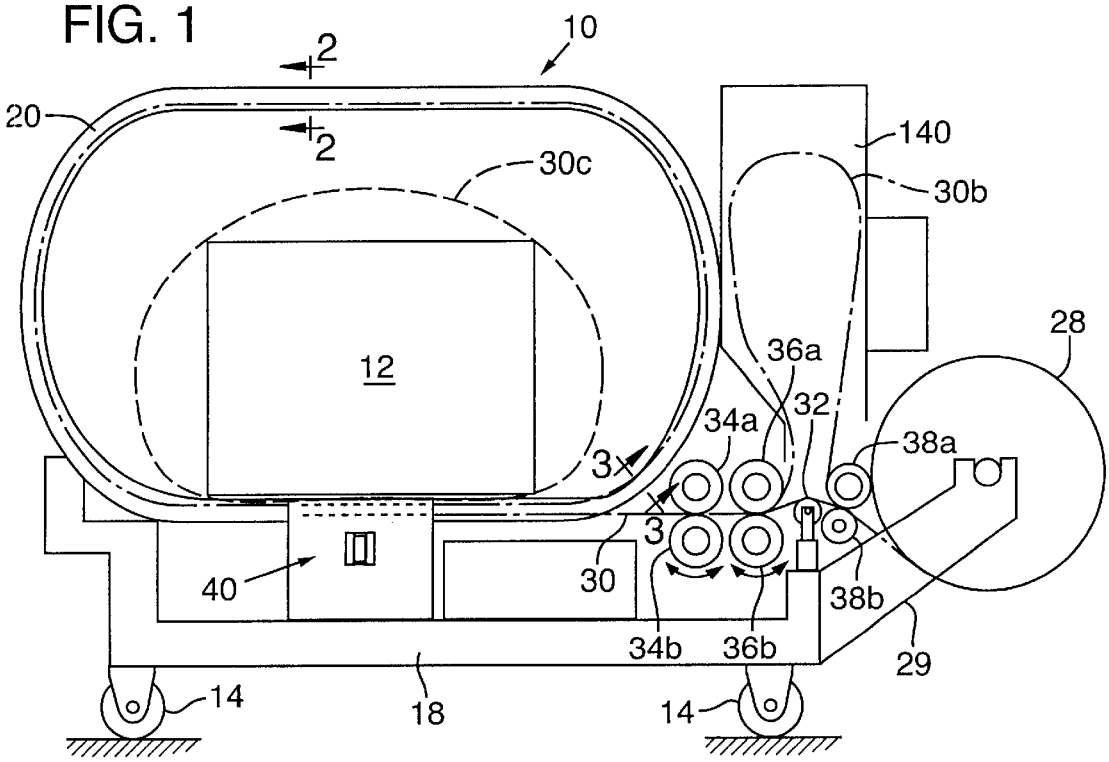
FIG. 1 is an elevation view of bundle strapping apparatus in which securing mechanism according to the present invention is operable.

Referring first to FIG. 1, at 10 is indicated generally strapping apparatus operable to drive a strap around a bundle 12, draw the strap tight, and secure the strap about the bundle. The bundle may be any type of material which requires containment by strapping, either by a single strap, or multiple straps placed at the same or various regions along the length of the bundle. Although not illustrated in detail in FIG. 1, bundle 12 rests on an underlying conveyor or table for movement along a path generally toward or away from the viewer in FIG. 1.

As is best seen in FIG. 1, apparatus 10 is mounted on casters 14 so it may be wheeled into a position within the conveyor line or removed therefrom as required.

Figure 2:
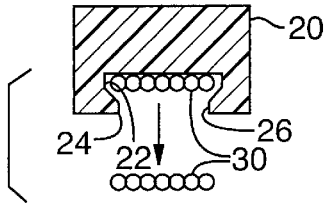
FIG. 2 is an enlarged cross sectional view taken along the lines 2—2 in FIG. 1.
Figure 3:
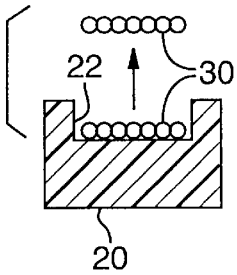
FIG. 3 is an enlarged cross sectional view taken generally along the lines 3—3 in FIG. 1.

The strapping apparatus includes a primary frame 18 on which is mounted a substantially oval guide track 20. The guide track is large enough to surround bundle 12, such that the bundle may pass therethrough. Throughout the major portion of guide track 20 it has the cross-sectional configuration illustrated generally at FIG. 2. The guide track 20 has a central channel 22 and a pair of shoulders 24, 26 which extend a short way inwardly toward the center from outer margins of channel 22. One corner of guide track 20, in the region indicated by the lines 3—3 in FIG. 1 and as shown in FIG. 3, has a substantially open channel 22, without shoulders 24, 26. It should be recognized that throughout the length of the guide track channel 22 opens toward the inner portion of the track facing bundle 12.

The apparatus includes arms, such as noted at 29, for mounting a roll of strap or tape indicated generally at 28.

The strap, indicated generally at 30, upon leaving roll 28 extends between a first pair of powered drive rolls 38*a,* 38*b,* over a spring-biased roller 32, and between a second set of drive rolls 34*a,* 34*b,* and a third set 36*a,* 36*b*. Rolls 34*b,* 36*b* are coupled to powered driving mechanism operable to drive them in either clockwise or counterclockwise directions as illustrated in FIG. 1. Roll 38*b* is coupled to driving mechanism operable to drive roll 38*b* in a counter-clockwise direction as shown in FIG. 1.

Figure 13:
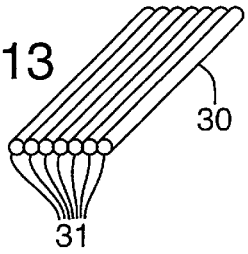
FIG. 13 is a perspective view of a portion of one form of strapping tape which may be used with the invention.

The tape, or strap, would be a generally flat tape having a heat sensitive adhesive thereon. Referring to tape, or strap, 30 one form of tape which has been found to work well in the present invention is illustrated generally in FIG. 13. The illustrated tape includes multiple elongate pulpable paper or fiber elements, or strands, 31 which are joined in side-by-side orientation by a heat sensitive adhesive which may be reactivated by application of heat. The strap, or tape, also may be in other configurations of fibrous materials such as, for example, folded or otherwise laminated layers of paper with a heat sensitive adhesive thereon.

One adhesive which has been found to work well is a polyvinyl alcohol. In the illustrated tape the adhesive lies both between the individual strands and on or closely adjacent the upper and lower face surfaces of the strap. Thus the multiple-strand paper, or yarn, tape in which the strands are secured by adhesive in side-by-side arrangement provides a substantially flat tape which has a width (as measured laterally between its opposed edges) which is a multiple of the thickness thereof (as measured between its upper and lower face surfaces). The tape, or strap, has sufficient flexibility and stiffness that it may be pushed by the drive rolls forwardly into and around guide track 20 to encircle a bundle.

It has been discovered that such a strap, or tape, which has an adhesive already thereon, such as in its matrix of strands, may be secured, or bound, about the bundle by placing two adjacent sections of the strap in face-to-face contact and applying heat and pressure to form an adhered joint therebetween. The applied heat softens, or reactivates, the existing adhesive in the tape so that it may be pressed together and produce a bond between the two portions of the tape as will be described in greater detail below.

Figure 4:
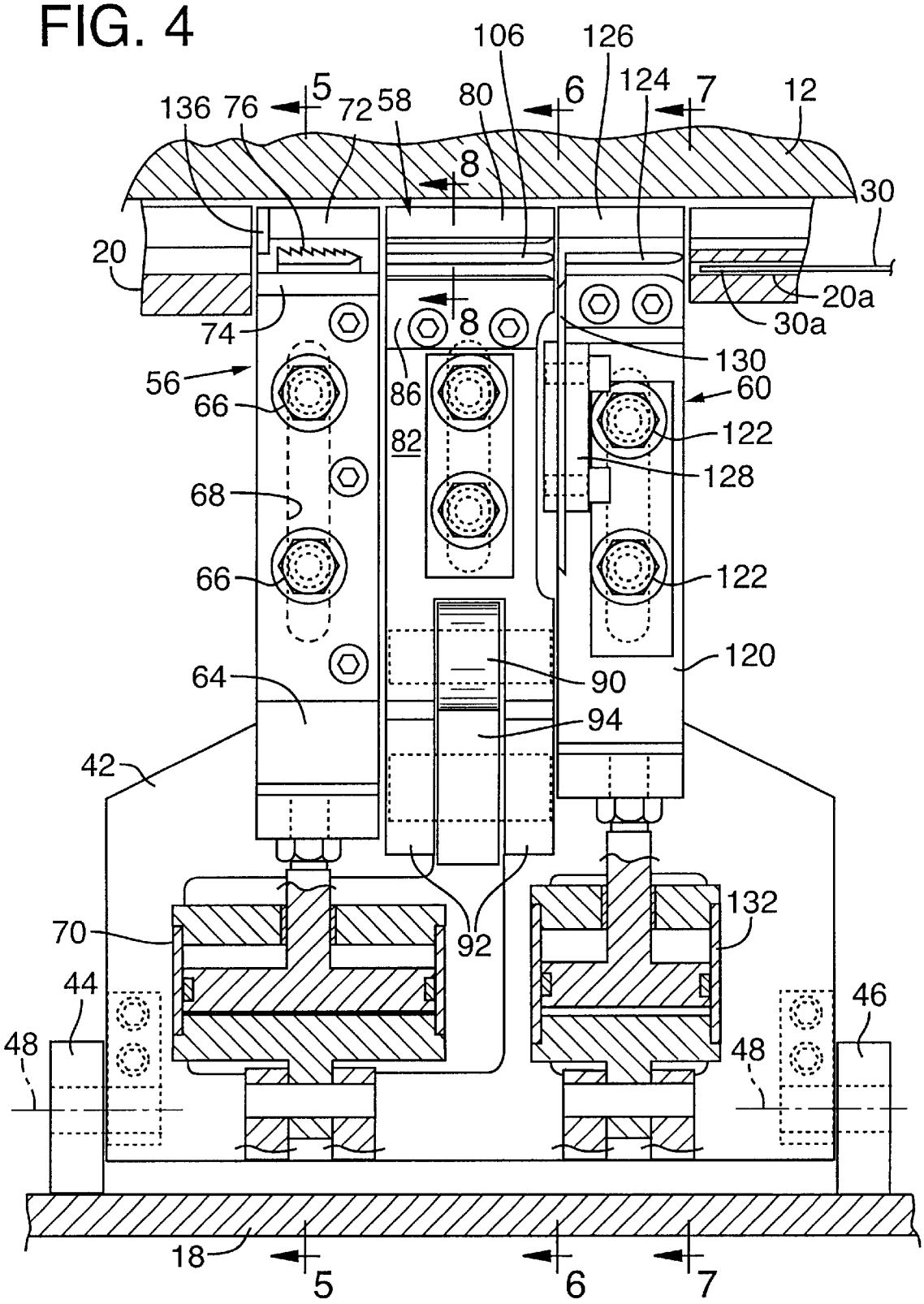
FIG. 4 is an enlarged elevation view taken generally in the same direction as FIG. 1 of strap securing apparatus according to the invention.

At 40 it is indicated generally in FIG. 1, and more specifically in FIG. 4, apparatus which is operable to bind the strap about the bundle. A cover plate obscures details of apparatus 40 in FIG. 4. Apparatus 40 includes a mounting frame 42 which is pivotally connected through pivot connections 44, 46 to frame 18 allowing pivoting of mounting frame 42 about pivot axis 48.

Figure 6:
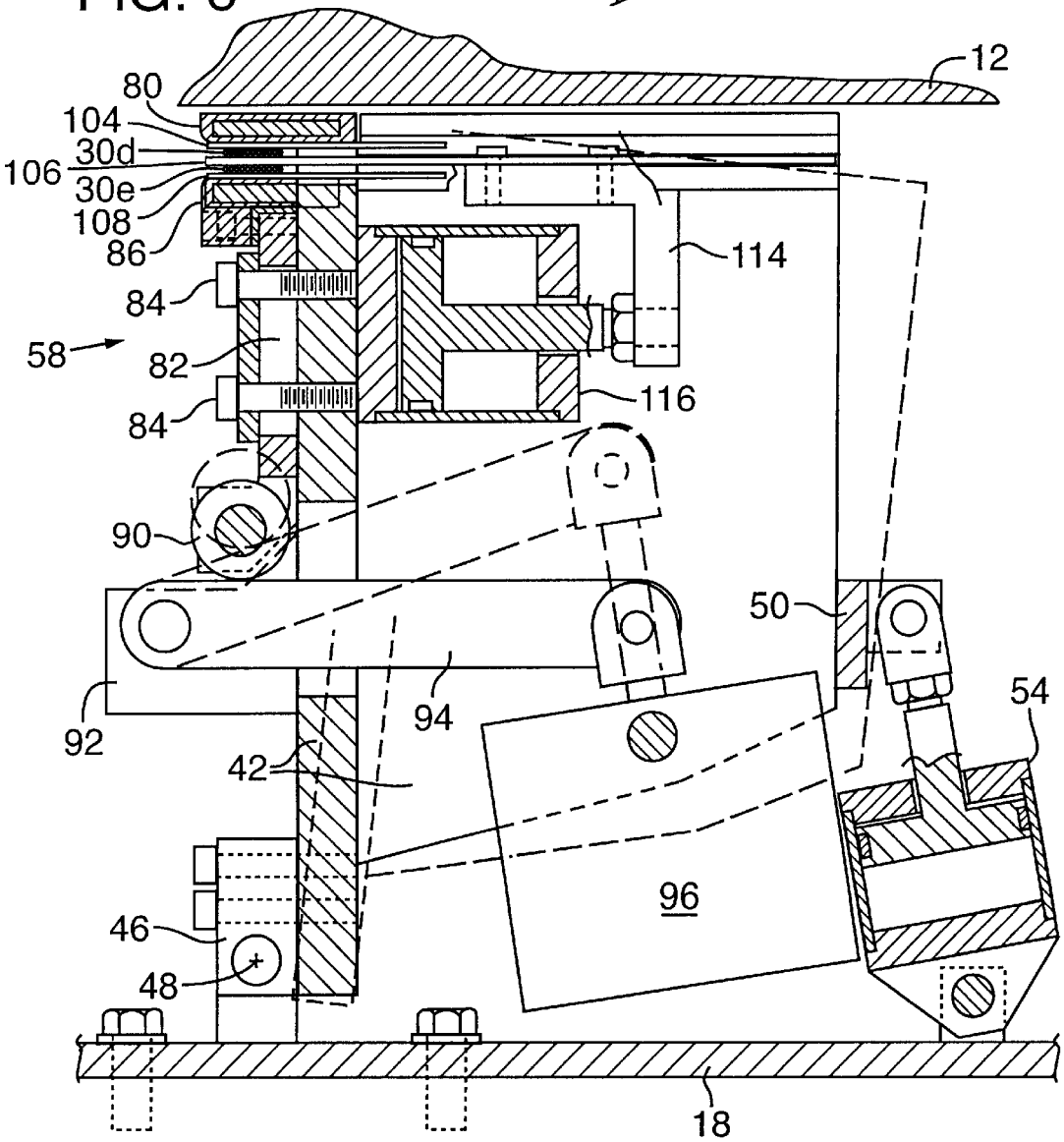
FIG. 6 is a cross sectional view taken generally along the line 6—6 in FIG. 4.

Referring to FIG. 6, the rear end of frame 42 has a cross bar 50 secured thereto. An extensible-retractable ram 54 is connected at its lower end to frame 18 and at its upper end to cross bar 50. With the ram extended mounting plate 42 is in its substantially upright, vertical, or operating, position illustrated in solid line in FIG. 6. When ram 54 is retracted mounting frame 42 is swung clockwise in FIG. 7 about pivot axis 48 to the release position illustrated in dashed outline. In its first, or upright position shown in solid outline the operative mechanism of the strapping apparatus is positioned to receive and bind a strap. On being swung rearwardly, or to the right in FIG. 6, the apparatus is positioned to release the strap which had been bound thereby, such that the strap is released from the binding apparatus to contact the bundle and move with the bundle along the conveyor. As seen in FIG. 6, the upper, or head portion, of frame 42 is positioned in a strapping region adjacent the underside of bale 12.

Referring again to FIG. 4, the binding apparatus includes three basic sections. These are a gripping section 56, a clamping section 58, and a severing section 60. The guide track 20 at the side of binding apparatus 40 toward the drive rolls (the right side in FIG. 4) has an infeed slot 20*a* which lies below and is separated from channel 22. Strap, or tape, 30 driven into the mechanism by drive rolls 34*b,* 36*b* being driven counterclockwise as shown in FIG. 1, drives a lead end of tape 30 through the upper portion of binding apparatus 40 as will be discussed in greater detail below, and then drives it further around oval track 20, such that its lead end then again enters the upper portion of binding apparatus 40.

Figure 5:
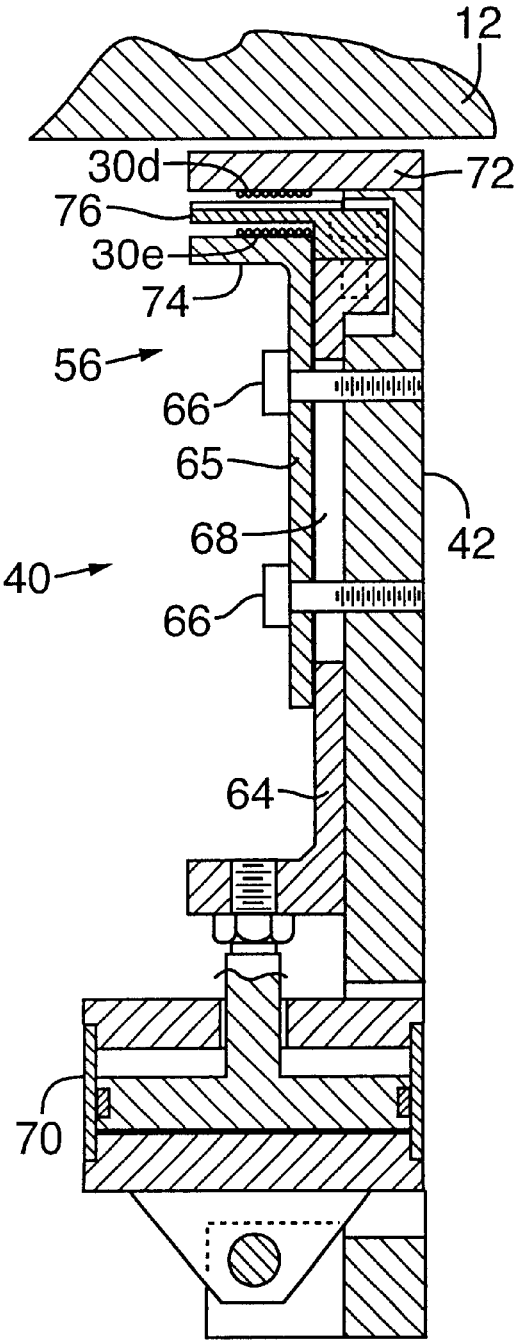
FIG. 5 is a cross sectional view taken generally along the line 5—5 in FIG. 4.

Referring first to gripping section 56 (FIGS. 4 and 5) the gripping section includes members 64 and 65 coupled to mounting frame 42 by bolts 66. Member 65 has bolt holes to receive bolts 66 which hold member 65 in a substantially stationary position relative to frame 42. Member 64 has an elongate slot 68 therein and bolts 66 extend through slot 68, such that member 64 may slide vertically relative to mounting frame 42. The lower end of member 64 is operatively connected to an extensible-retractable ram 70, the lower end of which is secured to mounting frame 42. The upper end of mounting frame 42 has a horizontally disposed anvil block 72 secured thereto. Secured to member 65 is a horizontally disposed guide plate 74 which is spaced below anvil block 72. Secured to member 64 and shiftable vertically therewith is a gripper arm 76 having a toothed horizontally disposed upper surface. A defined space is provided between plate 74 and gripper arm 76. When the ram 70 is retracted a space is provided between anvil block 72 and gripper arm 76.

Referring to FIGS. 4 and 6, clamping section 58 includes a substantially horizontally disposed press element, member, or plate, 80 secured to the upper end of mounting frame 42. Slidably mounted on the face of mounting frame 42 is a vertically shiftable plate 82 which is slidably coupled to mounting plate 42 by bolts 84 extending through an elongate slot in plate 82.

Mounted atop plate 82 is a substantially horizontally disposed press element, member, or plate, 86.

The lower end of plate 82 has a roller 90 rotatably coupled thereto. Extending outwardly, to the left, in FIG. 6, from mounting frame 42 is a mounting bracket 92 to which an elongate lever arm 94 is pivotally connected. The end of lever arm 94 remote from mounting bracket 92 is connected to the rod end of an extensible-retractable ram 96 secured to the mounting frame 42. Upon retraction of ram 96, arm 94 assumes the position illustrated in solid outline in FIG. 6. Upon extension of the ram 96, arm 94 moves to the position illustrated in dashed line. The lever arm 94 contacts roller 90, such that upon retraction of the ram the roller, plate 82, and press element 86 are in the positions illustrated in solid outline in FIGS. 4 and 6. Upon extension of the ram the roller 90, plate 82, and press element 86 are moved upwardly, such that press element 86 is forcibly pressed toward upper press element 80.

Either one or both of press elements 80, 86 are heated. The heating of these press element may be by electrical resistance heating units or other appropriate heating means as indicated generally at 98, 100 in FIG. 8.

Figure 8:
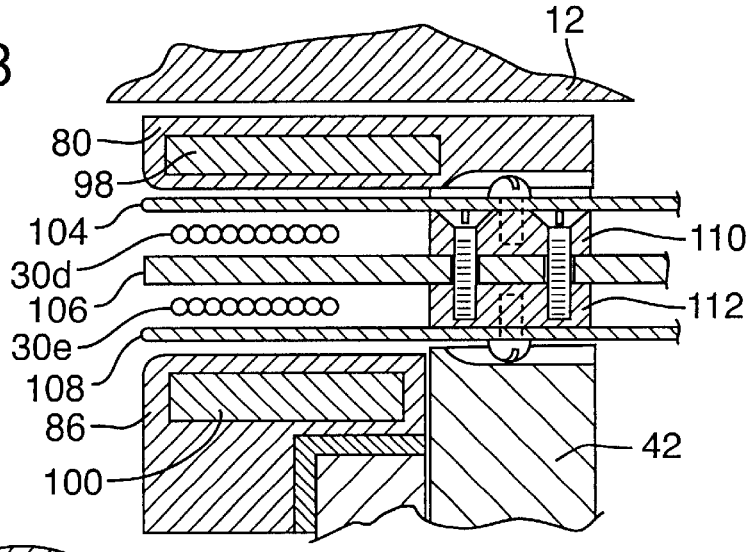
FIG. 8 is an enlarged view taken generally along the line 8—8 in FIG. 4.

Referring to FIGS. 6 and 8, slidably mounted for shifting horizontally in the space between press elements 80, 86 are separator members 104, 106, 108. The upper and lower separator elements 104, 108 are substantially planar, horizontally disposed heat insulator members (such as being made of ceramic) which in the position illustrated in FIG. 8 rest adjacent press members 80, 86, respectively. Intermediate separator element 106 is a substantially elongate flat plate member to which separator members 104, 106 are secured through separator blocks 110, 112 and a series of screws.

As best seen in FIG. 6, member 106 is secured to an angle member 114 which is operatively connected to a horizontally disposed extensible-retractable ram 116 mounted on frame 42. With the ram retracted as illustrated in FIG. 6, separator members 104, 106, 108 are in their extended position as illustrated in FIGS. 6 and 8 between press members 80, 86. Extension of ram 116 slides the separator elements to the right in FIGS. 6 and 8, such that they are all spaced to the right of the path of press element 86 which then may move vertically toward press element 80.

Figure 7:
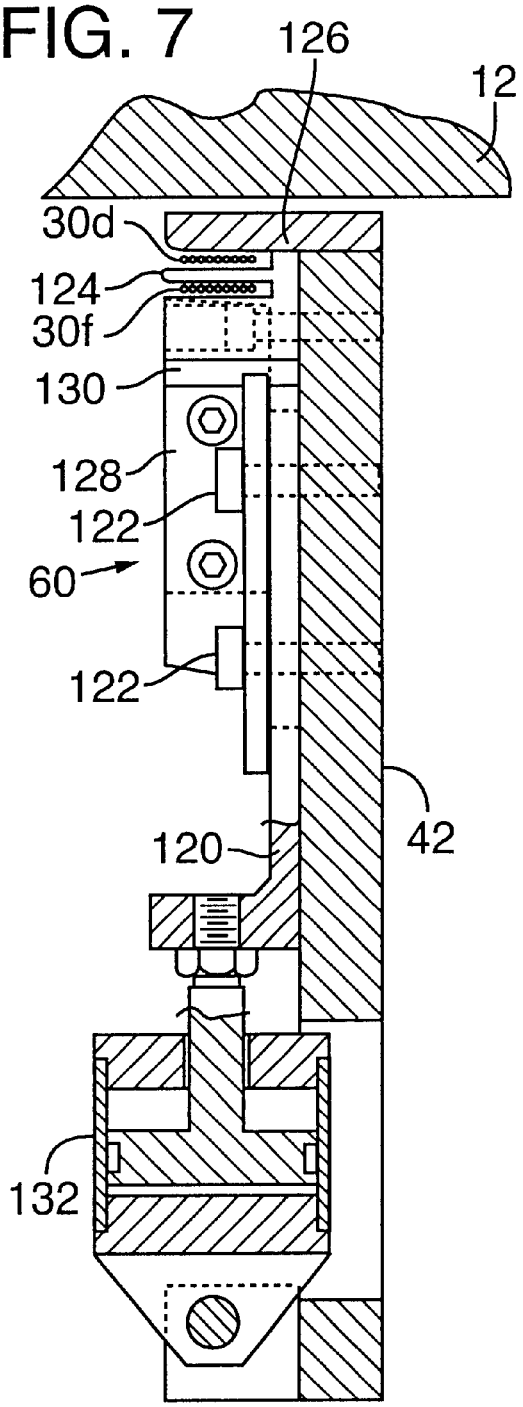
FIG. 7 is a cross sectional view taken generally along the line 7—7 in FIG. 4.

Referring to FIGS. 4 and 7, severing, or cutting, section 60 includes a plate 120 slidably mounted by bolts 122 on mounting frame 42 for shifting vertically relative thereto. A substantially horizontally disposed guide member 124 and horizontally disposed block 126 extend outwardly from frame 42, to the left as illustrated in FIG. 7, and in FIG. 4 extending toward the viewer.

A bracket 128 projects outwardly from plate 120 to the left in FIG. 7 and toward the viewer in FIG. 4. Mounted on bracket 128 is a knife blade 130 having a sharpened upper edge. The lower end of plate 120 is operatively connected to an extensible retractable ram 132. The lower end of ram 132 is coupled to mounting plate 42.

Describing the operation of the apparatus thus disclosed, and referring first to FIG. 1, tape, or strap, 30 from roll 28 is driven to the left by drive rolls 38*a*, 38*b*. A portion of the strap enters and is held between rolls 34*a*, 34*b*, 36*a*, 36*b*. At this time drive rolls 34*a*, 34*b*, 36*a*, 36*b* are held still. As rolls 38*a*, 38*b* continue to operate a portion of tape 30 to the left of rolls 38*a*, 38*b* is urged into an upward curve by spring-biased roller 32. Further driving of rolls 38*a*, 38*b* drives a quantity of tape 30*b* upwardly into an accumulator 140 where this reserve portion of tape is held loosely until needed for wrapping about a bundle.

Figure 9:
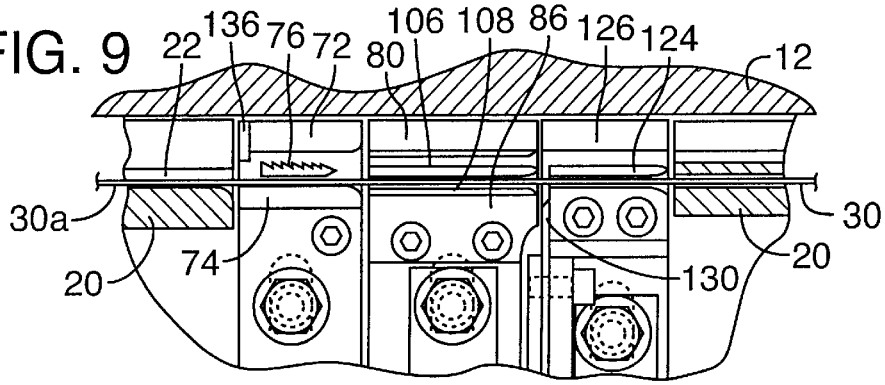
FIGS. 9, 10, 11, and 12 show sequential operation of the mechanism.
Figure 10:
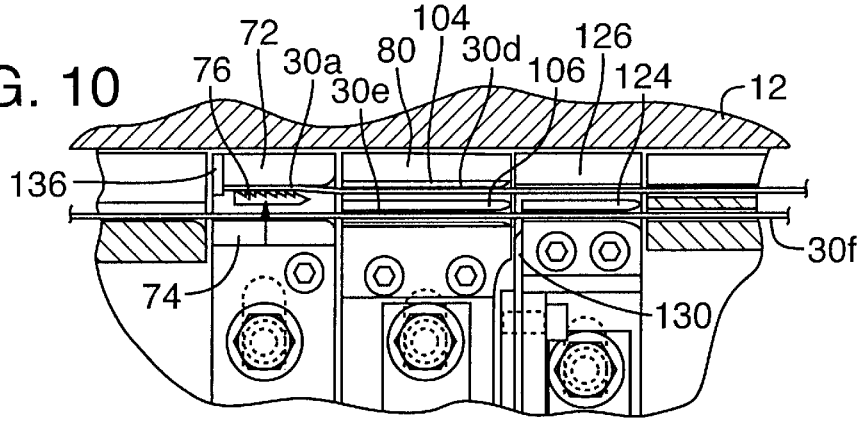

When a bundle is positioned in guide track 20 to be wrapped, rollers 34*a*, 34*b*, 36*a*, 36*b* are driven in a common direction and a leading end portion 30*a* of tape 30 is driven to the left and into lower guide slot 20*a* illustrated in FIG. 4. A first path for the leading end of such tape, or strap, as possibly best seen in FIG. 9, extends between guide member 124 and knife blade 130, between separator members 106, 108 (in a securing region between press members 80, 86), between gripper arm 76 and guide plate 74 and into the guide track channel 22 at the left side of the strap binding apparatus in FIG. 4. The strap has sufficient stiffness that it is driven around oval track 20 surrounding bundle 12 until the lead end of the tape 30*a* again comes into alignment with the strap binding apparatus 40. The lead end of the strap 30*a* thus extending about the bundle then enters a second guide path between guide member 124 and block 126 in the severing section, between separator members 104, 106 in the clamping section, or securing region, and between gripper arm 76 and anvil block 72 in the gripping section. The initial portion of this guiding of the strap is illustrated in the operation drawings of FIG. 9. The end portion of that just described is illustrated in FIG. 10.

As the leading end portion 30*a* of strap 30 proceeds through the gripping section it engages a stop sensor 136. The stop sensor is operatively connected to circuitry controlling rolls 34*a*, 34*b*, 36*a*, 36*b*, such that when the leading portion 30*a* engages sensor 136 these rolls are stopped. Ram 70 is extended to press gripper arm 76 upwardly to grip leading end 30*a* between the gripper arm 76 and anvil block 72.

With the leading end portion 30*a* of the strap thus gripped and held in place the drive rollers 34*a*, 34*b*, 36*a*, 36*b* are driven in a reverse direction and drive rolls 38*a*, 38*b* are held still. This draws remainder portions of the strap rearwardly, such that an intermediate position of the strap encircles the bundle. As the strap is drawn rearwardly roller 32 which is spring biased upwardly causes remainder portions of the strap noted generally at 30*b* to curve upwardly into an accumulator 140 such that it does not have to be taken up again on roll 28.

As the strap, or tape, is drawn rearwardly by the drive rolls an initial portion of the tape is pulled out of the section of the guide track channel illustrated in FIG. 3 and in the lower right corner of the track in FIG. 1. Further tightening of the strap causes the remainder of the strap to be pulled out of the guide track 22 past shoulders 24, 26 to surround the bundle. The strap position illustrated at 30*c* is only at an intermediate tightening point. When fully bound, the strap will be drawn taut about the bundle. When drawn taut the strap has overlapping inner, or first, and outer, or second, portions 30*d*, 30*e* extending through the spaces between separator members 104, 106 (for inner strap portion 30*d*) and between separator portions 106, 108 (for outer strap portion 30*e*). This is shown in FIG. 10.

With the strap drawn taut about the bundle and overlapping strap portions 30*d*, 30*e* positioned in clamping section 58, the separator elements 104, 106, 108 are shifted by ram 116 to the right in FIGS. 6 and 8 and out of the clamping section. Strap portions 30*d*, 30*e* are disposed with an inwardly facing inner surface of one contiguous an inwardly facing inner surface of the other. Strap portions 30*d*, 30*e* also have opposed outwardly facing outer, or external, surfaces. Ram 96 then is extended to raise press element, or member, 86 upwardly toward press element, or member, 80 so that the press members are forced against outwardly facing outer surfaces of and press strap portions 30*d*, 30*e* tightly against each. (See FIG. 11.)

As previously mentioned, press elements 80, 86 have heating elements 98, 100 associated therewith, such that the press elements are maintained in a heated condition. The press elements may be heated to an appropriate heat range for bonding the strap portions. The separator elements 104, 108 shield the tape from the heat of the press elements until such time as it is desired to press them together for bonding. Separator elements 104, 108 in their extended position as illustrated in FIG. 8 act as guides interposed between the strap portions and the press elements 80, 86 to keep the clean, or virgin, strap from contacting the heating press elements while it is being guided about the bundle and then drawn taut into its binding position. In this manner any glue, or other adhesive, which may have accumulated on press elements 80, 86 in prior pressing, or clamping, actions will not be deposited on the tape, or strap. In this way the strap is maintained substantially clean as it is guided about the bundle, and also does not transfer adhesive, or glue, onto the track or bundle.

Figure 11:
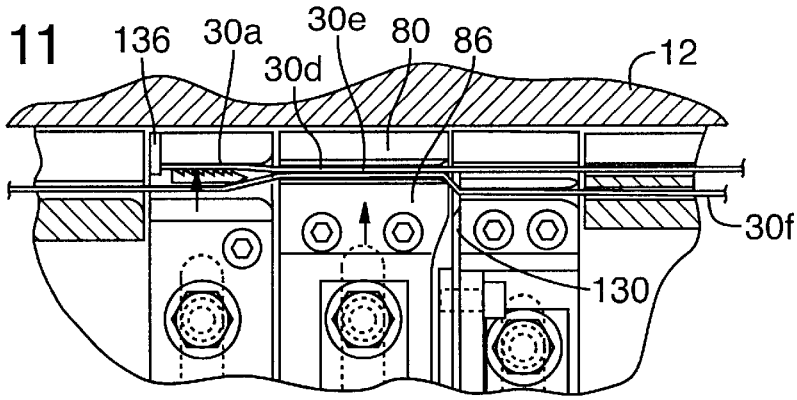

When the separator members 104, 106, 108 are retracted and press member 86 is pressed upwardly toward press member 80, overlapping strap portions 30*d*, 30*e* are pressed therebetween as illustrated in FIG. 11. The application of pressure and heat applied externally to the strap portions reactivates the adhesive in the tape causing them to bond to each other.

Figure 12:
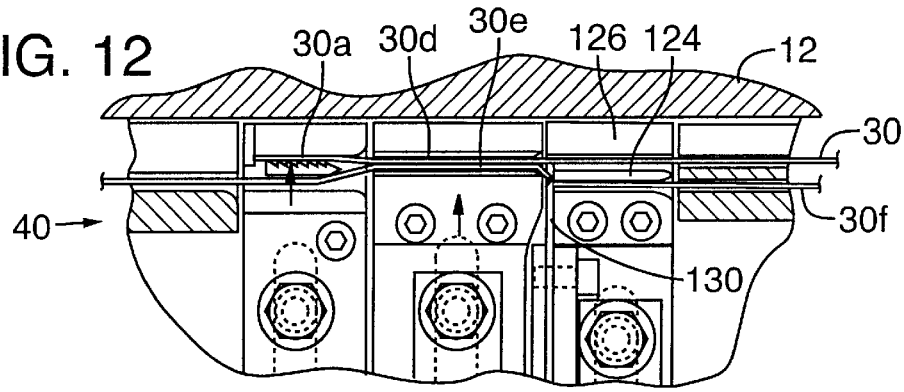

After bonding has occurred, and referring to FIG. 12, ram 132 of severing section 60 is extended to cause the knife blade 130 to shift upwardly to sever remainder portions 30*f* of the strap from the bonded portions. Strap portion 30*f* is then drawn back to move it out of section 60 and it is positioned as shown in FIG. 4 as 30*a* in infeed slot 20*a*.

Following gripping, clamping, and severing, as described above, rams 70, 96, and 132 are retracted, thus releasing the strap. Ram 54 then is retracted to swing the mounting frame and all of the strap binding apparatus clockwise as illustrated in FIG. 6. The binding head portions of the apparatus move substantially laterally of the tape, parallel to face surfaces of the tape, to release the bonded portions of the tape allowing them to contact the bundle, and allowing the bundle to move away therefrom. The binding head portions move generally parallel to the side of the bundle in the strap binding region. The tension of the strap around the object then pulls the joint upwards. Ram 54 then is extended to swing frame 42 back to its upright position as illustrated in FIG. 6 to receive another strap portion.

As an example of one embodiment of such strapping which has been found to work well, strap 30 may be composed of multiple, substantially parallel, elongate strands which are adhesively bound to each other by a polyvinyl alcohol adhesive. This adhesive is heat sensitive, and is able to be reactivated upon the application of heat in a range of 250 to 500° F., and preferably in a range of 300 to 400° F.

It also has been found that the press elements work well when heated into a range generally equivalent to the reactivating heat range for the adhesive in the tape. Thus, press elements 80, 86 are heated to a temperature in a range of 250 to 500° F., and preferably 300 to 400° F.

It has been found that a good bond is produced between overlapping strap portions upon application of heat in the 250 to 500° F. range and preferably in the 300 to 400° F. range by the press elements with the force exerted against the strap portions between the press elements being in a range of 2,000 to 3,500 pounds, and this heat and pressing force being applied externally to the strap portions for a dwell time of 3 to 8 seconds and preferably 3 to 5 seconds to allow joint set time.

Although not shown it has been found that setting of the adhesive may be accelerated by blowing cooling air onto the joint as it exits the binding head.

Due to the rapid cycle times required for strapping bundles in a production facility, it has been found preferable to maintain a reserve of loose tape, or strap, such as that illustrated at 30*b* in accumulator 140. Thus, as previously described, when remainder portions of the tape are driven rearwardly to draw the strap taut about the bundle and a loop of such tape is driven into accumulator 140. When it is then desired to drive a subsequent loop of tape around guide track 20 to encircle a bundle 12, the loosely held tape 30*b* in accumulator 140 is available and the inertia of roll 28 does not have to be overcome to start the strap about the bundle. It has been found that it is desirable to drive rolls 38*a*, 38*b* at appropriate times to maintain a reserve quantity of strap 30*b* in accumulator 140 so that such will be ready to be driven about a bundle as soon as the bundle is placed within the track.

Although the apparatus illustrated and described has been shown on the underside of a bundle carried along a conveyor, it should be recognized that the mechanism could be placed and would be operable if above or to either side of the bundle path.

With the described apparatus and method, bundles may be efficiently and effectively bound. No adhesive or other material needs to be interjected between the overlapped strap portions. No heating element needs to be inserted between and then withdrawn from the space between overlapping strap portions, as is necessary when using thermoplastic strapping. Further, the strap used may be more safely removed from a bundle and if it accompanies materials in the bundle to a following process there is less likelihood it will produce problems.

While a preferred embodiment of the invention has been described herein, it should be apparent to those skilled in the art that variations are possible without departing from the spirit of the invention.

What is claimed is:

1. A method for binding a bundle comprising the steps of providing an elongate strap formed of multiple elongate elements secured together by a heat sensitive adhesive which may be reactivated by the application of heat, extending said strap about the bundle, drawing the strap taut about the bundle with a first portion of the strap overlapping a second portion of the strap, pressing said first portion and second portion of the strap together and simultaneously applying heat externally to at least one of the overlapping portions of the tape to reactivate said adhesive to bond said first portion and second portion together in the region of overlap therebetween.

2. The method of claim 1, wherein intermediate portions of said strap between said first portion and said second portion extend about and bind said bundle and which further comprises the step of severing remainder portions of said strap from said first, second and intermediate portions of the strap.

3. The method of claim 1, wherein said heat sensitive adhesive is reactivated at a temperature in a range of from 250 to 500 degrees F. and heat is applied to at least one external surface of the overlapping tapes portions at a temperature sufficient to reactivate said adhesive.

4. The method of claim 1, wherein said heat sensitive adhesive is reactivated at a temperature in a range of from 300 to 400 degrees F. and heat is applied to at least one external surface of the overlapping tapes portions at a temperature sufficient to reactivate said adhesive.

5. The method of claim 1, wherein said first and second portions are pressed together with a force in a range of from 2,000 to 3,500 pounds.

6. The method of claim 5, wherein said first and second portions are pressed together for a period of from 3 to 8 seconds.

7. The method of claim 5, wherein said first and second portions are pressed together for a period of from 3 to 5 seconds.

8. The method of claim 1, wherein said strap is composed of a plurality of elongate strands of pulpable material bound together in side-by-side relation by a heat sensitive adhesive to form a tape having a thickness as measured between opposed face surfaces of the tape and a width several time said thickness, and said first portion and second portion are disposed with a face surface of one portion contiguous a face surface of the other portion for applying said heat and pressure.

9. The method of claim 8, wherein when heat and pressing force are applied said adhesive binding said strands together is reactivated to adhere said first portion and second portion together.

10. The method of claim 1, wherein said strap is composed of a plurality of laminated layers of fibrous materials bound together by a heat sensitive adhesive to form a tape having a thickness as measured between a opposed face surfaces of the tape and a width several times said thickness, and said first portion and second portion are disposed with a face surface of one portion contiguous a face surface of the other portion for applying said heat and pressure.

11. The method of claim 1, wherein a pair of press plates are provided, with one of said plates being movable toward and away from the other, at least one of said press plates is heated, and said first portion and second portion of the strap are positioned between said press plates with inwardly facing surfaces of the strap portions facing each other when the strap is drawn taut, and said press plates are pressed against outwardly facing surfaces of said strap portions.

12. The method of claim 11, wherein said adhesive is selected from a group of adhesives which is reactivated at a temperature is a range of from 250 to 500 degrees F. and one of said press plates is heated to a temperature in a range of from 250 to 500 degrees F.

13. The method of claim 11, wherein said adhesive is selected from a group of adhesives which is reactivated at a temperature is a range of from 300 to 400 degrees F. and one of said press plates is heated to a temperature in a range of from 300 to 400 degrees F.

14. The method of claim 1, wherein the adhesive is selected from a group consisting of polyvinyl alcohol.

15. A method for binding a bundle comprising the steps of providing an elongate strap having a heat sensitive adhesive thereon which may be reactivated by the application of heat, extending said strap about the bundle, drawing the strap taut about the bundle with a first portion of the strap overlapping a second portion of the strap, said portions having contiguous facing inner surfaces and opposed outwardly facing outer surfaces; and pressing said first portion and second portion of the strap together and simultaneously applying heat externally to at least one of said outer surfaces of the overlapping portions of the tape to reactivate said adhesive to bond said first portion and second portion together at the inner surfaces in the region of overlap therebetween.

16. The method of claim 15, which further comprises the steps of providing a roll of strap, providing a first drive for removing a length of strap from the roll, driving said length of strap to be held loosely in an accumulator, and providing a second drive for removing strap from the accumulator to extend the strap around the bundle.

17. The method of claim 16, wherein upon drawing the strap taut about the bundle portions of the strap not extending about the bundle are fed back into the accumulator.

18. A method for binding a bundle of material comprising the steps of providing an elongate strap having a heat sensitive adhesive thereon which may be reactivated by application of heat, feeding said strap to form a loop about the bundle with a leading end portion and a trailing portion of strap, holding said leading end portion in a stationary position, pulling the strap trailing portion to tighten the loop about the bundle while said leading end portion is held to provide overlapping inner and outer strap portions, in a securing region, with said strap portions having inwardly facing surfaces positioned contiguous to each other and opposed outwardly facing external surfaces, providing a pair of opposed press elements disposed to opposite sides of the securing region with the overlapping inner and outer strap portions therebetween, with at least one of the press elements being shiftable toward and away from the other press element, and at least one of said press elements being heated, pressing said press elements against said overlapping inner and outer strap portions to press said inwardly facing surfaces of said strap portions together and simultaneously applying heat externally to at least one of said outwardly facing external surfaces from said heated press element to reactivate said adhesive to bond said inner and outer strap portion together, and severing the trailing portion of the strap from said outer strap portion.

19. The method of claim 18, wherein following bonding of said inner and outer strap portions together and severing said trailing portion said leading end is released, said press elements are moved away from each other to release the overlapping inner and outer strap portions, and said press elements are shifted away from the strap portions in a direction generally parallel to a side of said bundle to release the strap to hold the bundle.

20. A method for binding a bundle of material comprising the steps of providing an elongate strap having a heat sensitive adhesive thereon which may be reactivated by application of heat, feeding said strap to form a loop about the bundle with a leading end portion and a trailing portion of strap, holding said leading end portion in a stationary position, pulling the strap trailing portion to tighten the loop about the bundle while said leading end portion is held to provide overlapping inner and outer strap portions, in a securing region, providing a pair of opposed press elements disposed to opposite sides of the securing region with the overlapping inner and outer strap portions therebetween, with at least one of the press elements being shiftable toward and away from the other press element, and at least one of said press elements being heated, pressing said press elements against said overlapping inner and outer strap portions to press said strap portions together and simultaneously applying heat externally thereto from said heated press element to reactivate said adhesive to bond said inner and outer strap portion together, providing a pair of movably mounted separator elements movable between an extended position in which one of the separator elements is interposed between the strap portions and one of the press elements and the other separator is interposed between the strap portions and the other press element when the strap is fed to form a loop about the bundle, and a retracted position removed from such positions interposed between the strap portions and the press elements to allow pressing said press elements against said overlapping inner and outer strap portions; and severing the trailing portion of the strap from said outer strap portion.

21. A method for binding a bundle of material comprising the steps of providing an elongate strap having a heat sensitive adhesive thereon which may be reactivated by application of heat, feeding said strap to form a loop about the bundle with a leading end portion and a trailing portion of strap, holding said leading end portion in a stationary position, pulling the strap trailing portion to tighten the loop about the bundle while said leading end portion is held to provide overlapping inner and outer strap portions in a securing region, providing a pair of opposed press elements disposed to opposite sides of the securing region with the overlapping inner and outer strap portions therebetween, with at least one of the press elements being shiftable toward and away from the other press element, and at least one of said press elements being heated, pressing said press elements against said overlapping inner and outer strap portions to press said strap portions together and simultaneously applying heat externally thereto from said heated press element to reactivate said adhesive to bond said inner and outer strap portion together, providing a first separator element interposed between said overlapping inner and outer strap portions and a second separator element interposed between the heated press element and its associated strap portion, said second separator element being insulative to inhibit heat transfer from said heated press element to the strap portion, and prior to pressing said press elements against said inner and outer strap portions moving said first and second separator elements away from said overlapping inner and outer strap portions; and severing the trailing portion of the strap from said outer strap portion.

22. The method of claim 21, wherein the other of said press elements also is heated, a third separator element which is insulative is interposed between said other of the press elements and its associated strap portion, and said third separator element is moved away from said overlapping strap portions prior to pressing said press elements against said overlapping strap portions.

23. Apparatus for binding a bundle with an elongate strap formed of multiple elongate elements secured together by a heat sensitive adhesive which may be reactivated by the application of heat, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, with said strap portions having inwardly facing surfaces positioned contiguous to each other and opposed outwardly facing external surfaces, a pair of opposed press elements disposed on opposite sides of said securing region with the first and second strap portions positioned between said press elements, at least one of said press elements being heated, clamping mechanism for shifting at least one of the press elements toward the securing region to clamp the first and second strap portions between said opposed press elements with said heated press element supplying heat and pressure externally to at least one of said outwardly facing external surfaces of said first and second strap portions to reactivate the adhesive therein to secure the first and second strap portions together, and a cutter for severing a strap trailing portion from the second strap portion.

24. The apparatus of claim 23, which further comprises a mounting frame having a head portion on which the gripper, press elements, and cutter are mounted and said frame head portion is mounted for shifting to move said gripper, press elements and cutter away from said securing region along a path generally parallel to a side of the bundle adjacent the securing region.

25. The apparatus of claim 24, wherein said gripper is mounted on said mounting frame for movement relative thereto.

26. The apparatus of claim 25, wherein one of said press elements is positioned on the mounting frame to be disposed between the securing region and a side of the bundle and the other of said press elements is positioned on the mounting frame to be disposed outwardly from said securing region away from said bundle.

27. Apparatus for binding a bundle with an elongate strap formed of multiple elongate elements secured together by a heat sensitive adhesive which may be reactivated by the application of heat, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, a pair of opposed press elements disposed on opposite sides of said securing region with the first and second strap portions positioned between said press elements, at least one of said press elements being heated, a pair of spaced separator elements mounted for movement between extended positions in which one of the separator elements is interposed between the strap portions in the securing region and one of the press elements and the other separator element is interposed between the strap portions in the securing region and the other press element, and a retracted position removed from such positions interposed between the strap portions and the press elements, clamping mechanism for shifting at least one of the press elements toward the securing region to clamp the first and second strap portions between said opposed press elements with said heated press element supplying heat and pressure to said first and second strap portions to reactivate the adhesive therein to secure the first and second strap portions together, and a cutter for severing a strap trailing portion from the second strap portion.

28. Apparatus for binding a bundle with an elongate strap formed of multiple elongate elements secured together by a heat sensitive adhesive which may be reactivated by the application of heat, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, a pair of opposed press elements disposed on opposite sides of said securing region with the first and second strap portions positioned between said press elements, at least one of said press elements being heated, a movable insulating separator element interposed between said one heated press element and said securing region to inhibit heat transfer from said heated press element to a strap portion adjacent said heated press element, clamping mechanism for shifting at least one of the press elements toward the securing region to clamp the first and second strap portions between said opposed press elements with said heated press element supplying heat and pressure to said first and second strap portions to reactivate the adhesive therein to secure the first and second strap portions together, and a cutter for severing a strap trailing portion from the second strap portion.

29. The apparatus of claim 28, which further comprises a movable intermediate separator element interposed in the securing region between said first and second strap portions.

30. The apparatus of claim 29, wherein said intermediate separator element is mounted for shifting into and away from said securing region.

31. The apparatus of claim 30, wherein said insulating separator elements are mounted for shifting into and away from said securing region, and which further comprises mechanism operable to shift said insulating separator elements away from said securing region prior to said press elements being clamped against said first and second strap portions.

32. The apparatus of claim 31, which further comprises an intermediate separator element interposed in the securing region between said first and second strap portions, said strap portions are in the form of a generally flat tape and the first and second strap portions are disposed in the securing region with contiguous face surfaces thereof substantially parallel, and said separator elements are mounted for shifting into and out of the securing region laterally of the strap along a path substantially parallel to said strap face surfaces.

33. The apparatus of claim 32, which further comprises mechanism for shifting said separators into and out of said securing region.

34. The apparatus of claim 29, wherein the other of said press elements is heated and which further comprises another insulating separator element interposed between said other press element and said securing region to inhibit heat transfer from said other heated press element to a strap portion adjacent said other heated press element.

35. Apparatus for binding a bundle with an elongate strap formed of multiple elongate elements secured together by a heat sensitive adhesive which may be reactivated by the application of heat, wherein the strap is substantially flat having a thickness and a width several times the thickness, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, a pair of opposed press elements disposed on opposite sides of said securing region with the first and second strap portions positioned between said press elements, at least one of said press elements being heated, clamping mechanism for shifting at least one of the press elements toward the securing region to clamp the first and second strap portions between said opposed press elements with said heated press element supplying heat and pressure to said first and second strap portions to reactivate the adhesive therein to secure the first and second strap portions together, and a cutter for severing a strap trailing portion from the second strap portion, the gripper, press elements and cutter are mounted on a common mounting frame for movement with the mounting frame toward and away from the securing region along a path substantially parallel to a flat surface of a strap portion in the securing region, and which further comprises an insulating separator element which is mounted on the mounting frame for movement therewith and for movement laterally of the mounting frame substantially parallel to a flat surface of the strap between a first position interposed between said one heated press element and said securing region and a second position spaced laterally therefrom.

36. The apparatus of claim 35 which further comprises a fluid actuated ram operatively coupled to said separator element to move said separator element between said first and second positions.

37. Apparatus for binding a bundle with an elongate flat strap having heat sensitive adhesive thereon which may be reactivated by the application of heat, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, with said strap portions having inwardly facing surfaces positioned contiguous to each other and opposed outwardly facing external surfaces, a pair of opposed press elements disposed on opposite sides of said securing region with the first and second strap portions positioned between said press elements, at least one of said press elements being heated, and clamping mechanism for shifting at least one of the press elements toward the securing region to clamp inwardly facing surfaces of said first and second strap portions together between said opposed press elements with said heated press element supplying heat and pressure to said first and second strap portions to reactivate the adhesive therein to secure the first and second strap portions together.

38. The apparatus according to claim 37, wherein said one press element has means for heating said press element into a range of from 250 to 500° F.

39. The apparatus according to claim 37, wherein said one press element has means for heating said press element into a range of from 300 to 400° F.

40. The apparatus of claim 37, wherein said clamping mechanism is operable to clamp the press elements together with a force in a range of from 2,000 to 3,500 pounds.

41. The apparatus of claim 37, wherein said mechanism for feeding the strap to form a loop about a bundle comprises a first drive mechanism operable to remove strap from a strap holder, a strap accumulator into which a loose length of strap may be driven by said first drive mechanism, and a second drive mechanism for removing strap held in the accumulator and driving it about a guide to form a loop about the bundle.

42. Apparatus for binding a bundle with an elongate flat strap having heat sensitive adhesive thereon which may be reactivated by the application of heat, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, a pair of opposed press elements disposed on opposite sides of said securing region with the first and second strap portions positioned between said press elements, at least one of said press elements being heated, a pair of spaced separator elements mounted for movement between extended positions in which one of the separator elements is interposed between the strap portions in the securing region and one of the press elements and the other separator element is interposed between the strap portions in the securing region and the other press element, and a retracted position removed from such position interposed between the strap portions and the press elements, and clamping mechanism for shifting at least one of the press elements toward the securing region to clamp the first and second strap portions between said opposed press elements with said heated press element supplying heat and pressure to said first and second strap portions to reactivate the adhesive therein to secure the first and second strap portions together.

43. Apparatus for binding a bundle with an elongate flat strap having heat sensitive adhesive thereon which may be reactivated by the application of heat, the apparatus comprising mechanism for feeding the strap to form a loop about the bundle with a leading end portion and a trailing portion of strap, a gripper for gripping and holding said leading end portion, mechanism for pulling the strap trailing portion to tighten the loop about the bundle to produce overlapping first and second strap portions with the first strap portion being positioned closest to the bundle and the second strap portion being positioned outwardly therefrom in a direction away from the bundle, said first and second strap portions being situated in a securing region, a pair of opposed press elements disposed on opposite sides of said securing region with the first and second strap portions positioned between said press elements, at least one of said press elements being heated, a movable insulating separator element interposed between said one heated press element and said securing region to inhibit heat transfer from said heated press element to a strap portion adjacent said heated press element, and clamping mechanism for shifting at least one of the press elements toward the securing region to clamp the first and second strap portions between said opposed press elements with said heated press element supplying heat and pressure to said first and second strap portions to reactivate the adhesive therein to secure the first and second strap portions together.

44. Apparatus for binding a bundle with an elongate flat strap having heat sensitive adhesive thereon which may be reactivated by the application of heat, the bundle having an outer side surface disposed in a swapping region when positioned for binding, the apparatus comprising a mounting frame mounted for shifting between a swapping position and a release position, with a head portion of the frame being disposed adjacent said strapping region when in its swapping position, a swap gripper, a swap cutter, and a pair of opposed strap press elements mounted on said mounting frame, with said press elements positioned intermediate said swap gripper and strap cutter, mechanism for feeding the swap to form a loop about the bundle with a first swap path extending through said swap cutter and strap press elements and a second strap path extending through said swap press elements and into said strap gripper intermediate said first swap path and said strapping region, with a leading end portion of the strap passing through said first swap path, around the bundle, and being stopped within said second swap path adjacent said strap gripper, with a first swap portion in said first path adjacent and overlapping a second strap portion in said second path, and a trailing portion of the strap extending from the first swap portion, with said strap portions having inwardly facing surfaces positioned contiguous to each other and opposed outwardly facing external surfaces, said strap gripper comprising a gripping head shiftable between a gripping position to grip said leading end portion of the strap and a release position, said press elements being mounted for shifting between release positions spaced outwardly to opposite sides of said first and second overlapping strap portions and pressing positions clamping said inwardly facing surfaces of said first and second overlapping swap portions together, with at least one of said press members being heated to apply heat externally to at least one of said outwardly facing external surfaces, and said swap cutter being mounted for shifting between a first position out of said first path and a cutting position extending into said first path to sever a strap therein.

45. The apparatus of claim 44, wherein said gripper, cutter and press elements are coupled to the head portion of the frame for movement therewith between said strapping and release positions.

46. The apparatus of claim 45, wherein said head portion and its associated gripper, cutter and press elements are mounted for movement along a path generally parallel to the outer side surface of the bundle on moving from said strapping position to said release position.

47. The apparatus of claim 46, wherein said mounting frame is mounted for pivoting about a pivot axis spaced from said head portion, with said pivot axis being disposed substantially parallel to said overlapping first and second strap paths.

48. The apparatus of claim 46, which further comprises frame operator mechanism for moving said frame between its strapping position and release position.

49. The apparatus of claim 44, which further comprises gripper operator mechanism for shifting said gripper between its release and gripping positions.

50. The apparatus of claim 44, which further comprises cutter operator mechanism for shifting said cutter from its first position to its cutting position.

51. The apparatus of claim 44, which further comprises clamp operator mechanism for moving at least one of said press elements between its release and pressing positions.

52. The apparatus of claim 44, which further comprises an electrical heating circuit operatively connected to one of said press elements for heating said one press element.

53. Apparatus for binding a bundle with an elongate flat strap having heat sensitive adhesive thereon which may be reactivated by the application of heat, the bundle having an outer side surface disposed in a strapping region when positioned for binding, the apparatus comprising a mounting frame mounted for shifting between a strapping position and a release position, with a head portion of the frame being disposed adjacent said strapping region when in its strapping position, a strap gripper, a strap cutter, and a pair of opposed strap press elements mounted on said mounting frame, with said press elements positioned intermediate said strap gripper and strap cutter, mechanism for feeding the strap to form a loop about the bundle with a first strap path extending through said strap cutter and strap press elements and a second strap path extending through said strap press elements and into said strap gripper intermediate said first strap path and said strapping region, with a leading end portion of the strap passing through said first strap path, around the bundle, and being stopped within said second strap path adjacent said strap gripper, with a first strap portion in said first path adjacent and overlapping a second strap portion in said second path, and a trailing portion of the strap extending from the first strap portion, said strap gripper comprising a gripping head shiftable between a gripping position to grip said leading end portion of the strap and a release position, said press elements being mounted for shifting between release positions spaced outwardly to opposite sides of said first and second overlapping strap portions and pressing positions clamping said first and second overlapping strap portions together, with at least one of said press members being heated, an insulating separator element movable between a first position interposed between said one heated press element and said securing region to inhibit heat transfer from said heated press element to a strap portion adjacent said heated press element, and a second position spaced therefrom, and said strap cutter being mounted for shifting between a first position out of said first path and a cutting position extending into said first path to sever a strap therein.

54. The apparatus of claim 53, wherein the other of said press elements also is heated and which further comprises another insulating separator element interposed between said other press element and said securing region to inhibit heat transfer from said other heated press element to a strap portion adjacent said other heated press element.

55. The apparatus of claim 54 which further comprises an intermediate separator element interposed in the securing region between said inner and outer strap portions.

* * * * *

UNITED STATES PATENT AND TRADEMARK OFFICE

CERTIFICATE OF CORRECTION

PATENT NO. : 6,546,696 B2
DATED : April 15, 2003
INVENTOR(S) : Cranston, III et al.

It is certified that error appears in the above-identified patent and that said Letters Patent is hereby corrected as shown below:

Column 5,
Line 14, “these press element” should be -- the press element --.

Column 6,
Line 56, “an” should be -- and --.

Column 8,
Lines 58 and 63, “tapes portions” should be -- tape portions --.

Column 9,
Line 24, “between a opposed face surfaces” should be -- between opposed face surfaces --
Lines 38 and 43, “is” should be -- in --.

Column 16,
Lines 49, 51-52 and 54, “swapping” should be -- strapping --.
Lines 55, 57, 59, 60, 61, 62, 63, 65, 66 and 67, “swap” should be -- strap --.

Column 17,
Lines 3, 14 and 18, “swap” should be -- strap --.

Signed and Sealed this

Third Day of February, 2004

JON W. DUDAS
*Acting Director of the United States Patent and Trademark Office*